United States Patent [19]

Schlepfer et al.

[11] Patent Number: 4,876,769

[45] Date of Patent: Oct. 31, 1989

[54] REGULATION OF PROCESSING STAGES OF A FIBER PROCESSING INSTALLATION

[75] Inventors: Walter Schlepfer, Winterthur; Christoph Staeheli, Frauenfeld, both of Switzerland

[73] Assignee: Reiter Machine Works, ltd., Winterthur, Switzerland

[21] Appl. No.: 254,407

[22] Filed: Oct. 6, 1988

[30] Foreign Application Priority Data

Oct. 8, 1987 [CH] Switzerland ..... 03943/87
Oct. 8, 1987 [CH] Switzerland ..... 03947/87

[51] Int. Cl.[4] ..... D01G 15/40
[52] U.S. Cl. ..... 19/105
[58] Field of Search ..... 19/105, 106 R, 240

[56] References Cited

U.S. PATENT DOCUMENTS

| | | | |
|---|---|---|---|
| 3,862,473 | 1/1975 | Felix | 19/240 |
| 4,163,927 | 8/1979 | Grice, Jr. | 19/240 |
| 4,393,547 | 7/1983 | Hösel | 19/105 |
| 4,494,204 | 1/1985 | Hösel | 19/105 |
| 4,497,086 | 2/1985 | Guse | 19/105 |
| 4,506,413 | 3/1985 | Leifeld | 19/105 |
| 4,653,153 | 3/1987 | Felix | 19/240 |

FOREIGN PATENT DOCUMENTS

| | | |
|---|---|---|
| 0176661 | 4/1986 | European Pat. Off. . |
| 3205776 | 8/1983 | Fed. Rep. of Germany . |
| 2515695 | 5/1983 | France . |
| 2534600 | 4/1984 | France . |

*Primary Examiner*—Werner H. Schroeder
*Assistant Examiner*—Douglas E. Price
*Attorney, Agent, or Firm*—Kenyon & Kenyon

[57] ABSTRACT

The fiber processing installation monitors the operation of a discontinuously operating stop/go stage to obtain an actual value signal corresponding to the ratio of operative time to inoperative time as well as the total production of a continuously operating downstream stage, such as a card room, to establish a set value signal. A deviation of the actual value from the set value provides a control signal to adjust the ratio of operative time to inoperative time of the upstream stage so as to maintain the total production of the installation constant.

14 Claims, 3 Drawing Sheets

Fig. 1
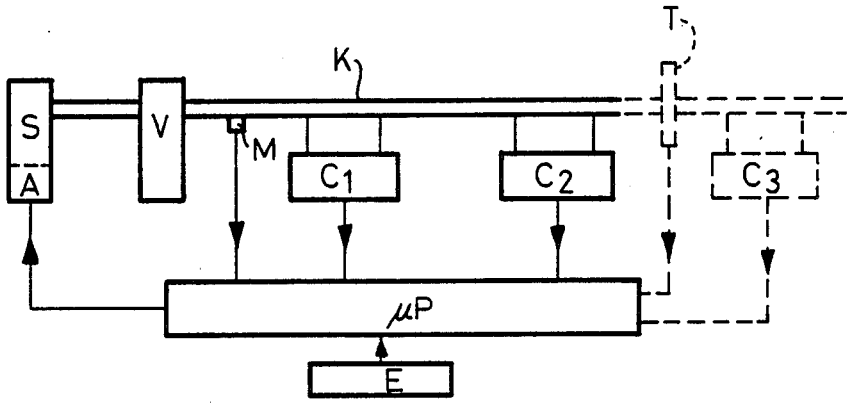
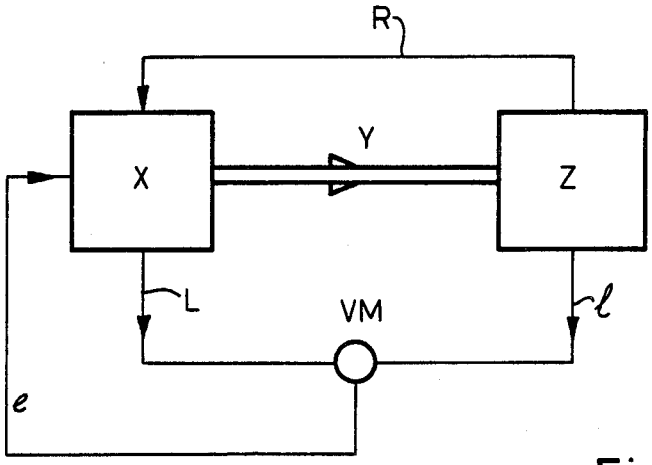
Fig. 2

Fig. 5A
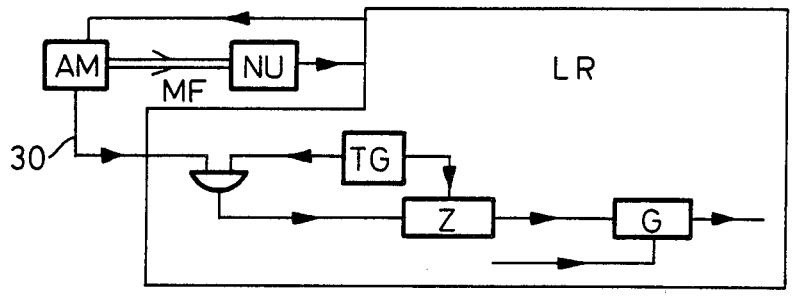
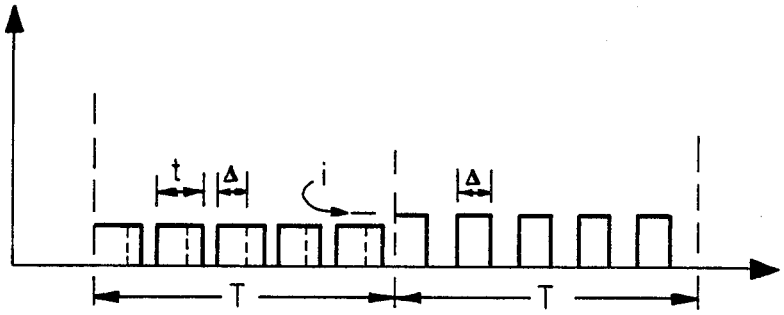
Fig. 5B

REGULATION OF PROCESSING STAGES OF A FIBER PROCESSING INSTALLATION

This invention relates to the regulating of the processing stages of a fiber processing installation. More particularly, this invention relates to a fiber processing installation and a method of processing fiber in the installation.

Automatic removal of material from bales, for example, in spinning mills, by a reciprocating bale opener is now well-established in short-staple spinning, and various proposals have been made for controlling the removal operation, for example as described in European Patent Application No. 93235 and corresponding U.S. Pat. No. 4,566,152.

These proposals include a method in which a removal unit is in stop/go operation and the depth of removal or the speed of operation of the unit is controllable in order as far as possible to maintain a continuous "optimum" ratio of operative to inoperative time. The bale material removal is switched on and off by control signals obtained from the next processing stage.

It is also known to determine the supply of material from the bale material removal unit to the first cleaning stage by using a control signal obtained from the card such as described in U.S. Pat. No. 3,151,697 in order to avoid downtimes of the blow-room machines or to operate the cleaning machines substantially continuously.

It is also known, however, to operate the blow-room line continuously, using the cards to obtain a control signal for the various machines in the line as described in Melliand Textilberichte, 2/1987, pages 77 to 83, more particularly page 81, -compare DOS 3237864 (French Patent Application 2534600) and U.S. Pat. No. 4,535,511 (corresponding to DOS 325446719).

Finally, it is also known to control the fiber supply at the cards themselves, using the number of producing cards as described in DOS No. 3442942. Also, as stated in Swiss Patent Application No. 3109/87, a change in fiber processing is usually undesirable, since it may result in changes in the quality of the end product (yarn). At best, the cited prior art contains no control concept for keeping the fiber processing constant; in some cases (e.g. EU 93235) the control concept is based on a change in fiber processing.

Accordingly, it is an object of the invention to obtain a uniform quality of end product from a fiber processing installation.

It is another object of the invention to be able to control the individual stages of a fiber processing installation in dependence upon the total production of the installation.

It is another object of the invention to provide a constant quality of output from a fiber processing installation.

Briefly, the invention provides a fiber processing installation comprising a number of fiber processing stages, the fibers for processing being conveyed successively from stage to stage and at least one stage being in stop/go (i.e. discontinuous) operation whereas a stage following it continuously supplies a predetermined product (e.g. a sliver). The "stages" are defined in accordance with the technology and not the machines. A "stage" can therefore comprise a plurality of individual machines. For example, a carding stage can comprise between six and twenty individual cards or machines.

The delivered product (or output) of a stage accordingly comprises the production of all machines operating at that moment in the stage.

In accordance with the invention, a means is provided for determining a set value for the operative/inoperative time ratio in the stage (upstream) which is in stop/go operation. Monitoring means are also provided for monitoring the actual operative/inoperative time ratio of this stage and comparing the resulting actual value with the preset value. If the actual ratio differs from the set ratio, the production of the stage, which remains constant during normal operation, can be either increased or reduced in order to adjust the actual ratio to the set ratio.

So far, the features of this invention are similar to those in European Patent Application No. 93235.

The invention, however, is characterized in that the set value is not permanently adjusted as proposed in European Patent Application No. 93235 but is variable in dependence on the production of the following stage (which is continuously producing during normal operation).

The installation can be so designed that a change in production of the end stage results immediately in a corresponding change in the set operative/inoperative time ratio in each discontinuously-operating stage upstream, the "corresponding change" being individually determinable for each stage upstream.

One way of determining operation is for the set ratio to take a theoretically optimum value (e.g. 90:10—see European Patent Application No. 93235) when the following stage is in full production. The set ratio can then be reduced in linear manner as the production of the following stage decreases. The optimum adjustment function for a particular installation can be determined empirically and input into the system, and when an adjustment is made to a number of stages, the adjustment function can vary from stage to stage.

The actual operative/inoperative time ratio can be monitored in accordance with the principles described in European Patent Application No. 93235, and when a bale material removal stage is the upstream stage, the production can also be changed as described therein, i.e. by altering the material removal depth or the speed of the material removal unit. The invention can thus be incorporated without difficulty in stages in order to regulate the operative/inoperative time ratio of the upstream stage in accordance with preset states in the downstream stage (e.g. the filling level in a store).

Preferably, the installation is controlled by a computer which monitors the production of the downstream stage and correspondingly determines the set ratio for the stage or stages upstream. The computer can also be used to obtain regulating circuits between stages upstream.

These and other objects and advantages of the invention will become more apparent from the following detailed description taken in conjunction with the accompanying drawings wherein.

FIG. 1 schematically illustrates a fiber processing installation constructed in accordance with the prior art;

FIG. 2 diagrammatically illustrates a modification of the installation of FIG. 1 constructed in accordance with the invention;

FIG. 5A illustrates a circuit diagram for a part of a computer used in the installation of FIG. 4; and FIG. 5B illustrates a time diagram for explaining the regulating connections of the installation of FIG. 4.

Figure 3:
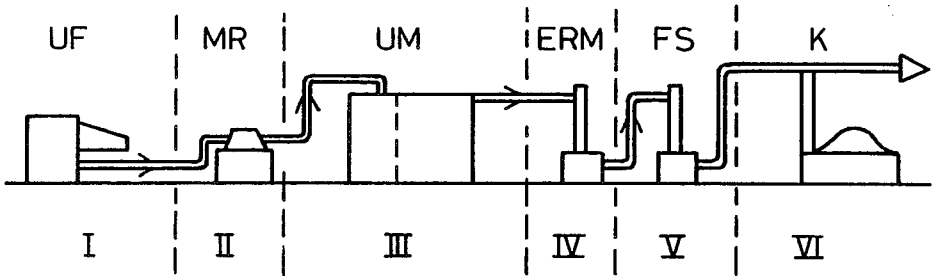
FIG. 3 illustrates a diagrammatic side view of a fiber processing installation in a short staple spinning mill in accordance with the invention.

Referring to FIG. 1, the fiber processing installation comprises a feed machine S, a fan V, a feed duct K, two cards C1 and C2 each having a filling chute (not shown), a microprocessor control system μP and a controllable drive A for the feed machine S. A measuring device M for measuring the static pressure is incorporated in the duct K between the fan V and the first card C1 to deliver an output signal to the microprocessor μP. Each card C1, C2 delivers a signal to microprocessor μP to show whether this card is in operation or not at that moment. Microprocessor μP delivers a control signal to the drive A of feed machine S.

The fan drive (not shown) which operates at a constant speed n is not controllable by the control system μP.

The control system has to co-operate with the other elements so that the filling chute of each producing card remains "full" within certain tolerances. As disclosed in Swiss Patent Application No. 3109/87, the static pressure in duct K at measuring device M can represent the filling conditions. If the measured static pressure moves outside a range determined by the microprocessor μP, the feed is switched on (if the pressure is falling) or off (if the pressure is rising). The feed is therefore in stop/go operation.

The control system μP switches the feed drive A on and off only; in this example, the control system has no influence on the speed of the drive, i.e. on the instantaneous production of the feed machine. The instantaneous production is predetermined for normal operation and kept constant, resulting in a constant quality (processing of fibers). The set production must be adequate for the maximum possible "demand" from the connected cards. Normally, a certain "excess production" is set so that if all the connected cards are producing at a maximum rate, there is an efficient ratio between the inoperative and the operative time of the feed machine during stop/go operation, e.g. 90% operative to 10% inoperative time.

As shown by broken lines in FIG. 1, the described method of control is not restricted to a single installation with only two cards. As also mentioned in Swiss Patent Application No. 3109/87, if the line is non-adjustable, the instantaneous production of feed machine S can be fixed or pre-set when the installation is assembled. If, however, the number of cards allocated to a feed machine can be altered, e.g. by actuating a separating means T (FIG. 1), there is no advantage in pre-setting the production of feed machine S. As provided in the Swiss Application, the production needs to be adjusted to the number of cards allocated to the feed machine, to obtain an optimum operative/inoperative time ratio for each preset allocation.

Of course, there are various possibilities of adjusting the instantaneous production of the feed machine to the number of cards allocated thereto. The production can e.g. be adjusted manually at the machine itself, in which case the control system μP will be used only for switching on and off. Alternatively, the adjustment can be made by the control system μP, if given the required information. If, for example, the line contains separating means T as indicated by broken lines in FIG. 1, the separating means can also be connected by a signal line to the control system μP, thus informing the control system about the instantaneous "effective structure" of the line. In the example shown, the separating means T blocks the feed duct K between card C2 and a third card C3. If the separating means T is made inoperative, card C3 can also be supplied with flocks by machine S via duct K.

In this system, the average production of the feed machine must correspond to the total production of the cards allocated thereto. The average production of the feed machine is dependent on (a function of) the set instantaneous production and the operative/inoperative time ratio. Although the cards run "continuously", the total production from the card system is still subject to fluctuations, e.g. one card can be temporarily switched off for some reason.

Since the instantaneous production of the feed machine in FIG. 1 is permanently set for normal operation (without altering the allocation), the operative/inoperative time ratio must be adjusted in order to compensate for fluctuations in the total production of the cards. Normally, this is an uncontrolled procedure which is not always free from disturbance. The invention provides a means for controlling these processes.

According to the invention, the operative/inoperative time ratio of feed machine S is monitored, as already proposed in the case of bale material removal in European Patent Application No. 93235. Since the control system, i.e. microprocessor μP switches the drive A on and off, the microprocessor can without difficulty determine the operative (or inoperative) time of the feed machine over a preset time interval, which is equivalent to determining the operative/inoperative time ratio for this interval (or, if required, enables the ratio itself to be calculated). This actual ratio is then compared with a set ratio and any deviations are determined. The instantaneous production of the feed machine is then adjusted (e.g. by altering the speed of the feed roller during operation thereof) in order to counteract the deviation. The set ratio, however, is not permanently set but is calculated by the processing in dependence on the number of producing cards. Possible methods of calculation will be described hereinafter with reference to FIGS. 3 to 5.

Referring to FIG. 2, box Z represents the end stage (card room) of the fiber processing installation line, which is supplied by an upstream stage X resulting in a material flow Y (from X to Z). By means of a feedback R, the material flow is switches on and off in dependence on consumption.

The operative/inoperative time ratio of stage X is determined by suitable means and a corresponding actual value signal is supplied via line L to a comparator VM. A measurement determining total consumption is converted in stage Z into a signal representing the set ratio and delivered via line 1 to comparator VM.

Any deviations between the actual value signal and the set value signal are detected the comparator VM and fed as a control signal e to the stage X which evaluates the signal e so as to change the instantaneous production of this stage. The necessary change, however, will be small (fine adjustment) because stage Z at this time is supplying correspondingly less material via feedback R—the control signal e facilitates adjustment of stage X to the behavior of stage Z. The adjustment can therefore be made relatively quickly, since the system is not dependent on "hunting" for an uncontrolled operative/inoperative time ratio. However, neither is it restricted to a "rigid" ("optimized") ratio (as suggested in European Patent Application No. 93235), which results in relatively large changes in fiber processing (and corresponding fluctuations in the quality of the end product).

The process can also be used for controlling other stages upstream, as will now be explained in connection with the other Figures.

FIG. 3 is a diagram of a installation comprising six "stages" I to VI of an installation which corresponds to the most common conventional processing line in a short-stable spinning mill, from bale material removal (stage I) to a card room (VI). The material (fibers or flocks) is pneumatically conveyed between the various stages as indicated by diagrammatic pipelines (double arrows) in FIG. 3 and the stages are disposed in a preset sequence.

By way of example, a line as per FIG. 3 will be explained in detail with reference to corresponding machines belonging to Rieter Machine Works Limited, but is in no way limited to the use of these particular machines. Stage I can be a single "Unifloc" (Registered Trade Mark) type machine and stage II can be a "Mono Roller Cleaner" type cleaning machine. Stage III can be a single "Unimix" (Registered Trade Mark) type mixing machine and stage IV can comprise a "Unit Cleaning Machine" (ERM) type fine operator.

Stage V comprises an ERM machine together with a transport fan (not shown) forming a flock feed unit FS. This unit is for supplying flocks to a number of cards K which together form stage VI, each card K being equipped with a separate filling chute and the filling chutes being connected to a common feed duct extending from the transport fan of stage V.

Figure 4:
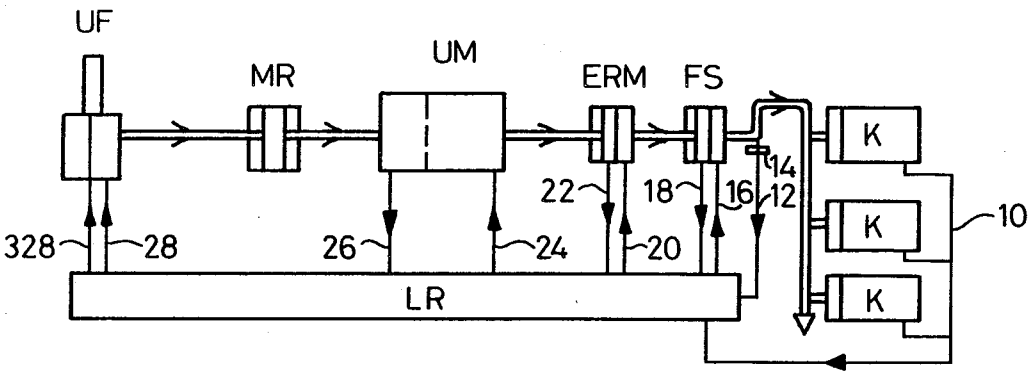
FIG. 4 illustrates a diagrammatic plan view of the installation of FIG. 3.

During normal operation, each card K operates continuously and delivers a continuous sliver (not shown). The receivers of the cards K are connected by a line 10 (FIG. 4) to a master computer LR, thus informing the computer whether each card is instantaneously in operation or not. Only three cards K are shown in FIG. 4, but the total installation can of course comprise a much larger number of these machines; the master card K.

A pressure sensor 14 reacts to the static pressure in the feed duct to the cards K and delivers a corresponding signal via a line 12 to the computer LR. As previously described, the computer sends a corresponding signal to the flock feed unit FS via a line 16 in order to switch the flock feed on or off.

The flock feed unit FS also has a filling chute which receives material from the ERM machine in stage IV. A level monitor (not shown) incorporated in the chute is connected by a line 18 to the computer LR, so that the computer via a line 20, can switch the delivery from the ERM machine on or off. A similar level monitor (not shown) of the ERM machine delivers a signal via a line 22 to the computer LR for controlling the delivering of the mixing machine UM via a lines 24.

The feed box of the mixing machine UM is also equipped with a level monitor (not shown) which delivers a signal via a line 26 to the computer LR. Correspondingly, the computer LR sends signals via a line 28 to the motor (not shown) driving a bale material removal unit UF in order to switch the bale material removal on or off.

As this description clearly shows, stages I, III, IV and V operate discontinuously (stop/go) and each upstream stage is connected by a regulating, i.e. feedback, circuit to a downstream stage. As shown diagrammatically in FIG. 5*a*, the regulating circuit comprises the actual material flow MF, the level monitor NU for the downstream stage, the signal connection to the master computer LR, the drive motor AM of the upstream stage and the signal connection between the computer and the drive motor. These regulating circuits are of course well known in the art.

During operation, the operative/inoperative time ratio of at least one upstream stage, preferably stage I, is monitored by the master computer LR and compared with a set value. To this end, a signal corresponding to the operative time of the drive motor AM (FIG. 5A) is sent via a line 30 to the computer LR. This signal and a clock signal from a clock TG are subjected to an AND operation (diagrammatically represented by an AND gate) and the resulting signal is delivered to a counter Z. The counter also receives the clock signal from clock TG and uses it to define predetermined time periods T (FIG. 5B) of equal length. Within these periods T, counter Z either adds the time intervals t during which the drive motor AM is operating, or adds the relatively short pauses in between. From these values, the counter Z calculates an average value for the actual operative/inoperative time ratio of the corresponding stage upstream.

The output signal of counter Z representing the actual ratio is delivered to a comparator G and is compared with a signal representing a set value. A signal showing deviations, if any, is converted by the computer LR to a corresponding control signal in order appropriately to alter the actual production of the machine upstream. Assuming that the computer LR thereby controls the production of stage I (the base material removal machine), the desired change of operation can be made via one or the other or both of two methods of adjustment, i.e. by adjusting the depth of material removal or adjusting the speed of travel of the unit. Corresponding signals can be supplied via line 28 (speed of travel) to the motor driving the total unit/or via line 328 (FIG. 4) to a height adjusting device (not shown) for the bale material removal component of the unit (see European Patent Application No. 93235 and European Patent Application No. 4660257).

The signal representing the set value and delivered to device G has to be generated by the master computer LR in dependence on signals received through line 10. In the preferred embodiment, the set value is chosen stepwise in dependence on the number of cards instantaneously in operation, the important thing being not necessarily the absolute number but only the proportion of cards in operation as compared with the maximum number. If for example, all cards are in operation, the set value for the operative/inoperative time ratio of the bale material removal machine can be set at 90:10. If only two thirds of the cards are in operation, the set ratio for the bale material removal machine can be reduced to 60:40—a linear adjustment of conditions to the reduced number of cards in operation.

Each intermediate stage can also be individually monitored by the master computer LR. The intermediate stages usually have only one adjustment facility for altering the stop/go ratio, i.e. by altering the speed of the flock or fiber supply unit feed rollers.

Possible changes are shown diagrammatically in FIG. 5*b*. In normal operation, at full production in stage VI (all cards K in operation), the bale material removal machine during a period T runs for five intervals t, shown by continuous lines (such regular operation is of course extremely unlikely in practice but illustrates the principle). If one or more cards stop production, the duration of each interval during the given time period T must be reduced (Δ), shown by broken vertical lines.

If the effective production of the stage upstream (average value over the period T) is insufficient to keep the filling level in the downstream stage within set limits, the maximum production of the stage upstream (constant over each time interval) must be increased in order to maintain the newly-adjusted set ratio for the operative to inoperative time. Such an increase is denoted by i between the first and second time period in FIG. 5B, the duration Δ of each interval in the second time period being equal to the duration of the reduced intervals Δ (shown by broken lines) in the first time interval.

As FIG. 3 shows, the production of the first continuously operating stage (the card room in the example) determines the set value for the operative/inoperative time ratio of at least one and preferably all the discontinuously operating stages upstream. These, however, are not necessarily all the stages upstream. The mono roller cleaner (stage II in FIG. 3) operates continuously although stages I and III both operate discontinuously. In this case, stage II plays no part in the "regulating chain" which simply skips this stage via the connection between the storage box, computer and bale opener.

The above described technique is not restricted to the use of a card production signal for controlling the machines upstream. The production signal, however, should be continuously available and should reliably measure the actual production of the line. The first stage in the line which can fulfill these conditions is preferably chosen as the determining stage for controlling the machines upstream. In a short staple spinning mill, these conditions cannot normally be fulfilled until the card room.

Normally, the set production will be the same for each individual card. In that case, the instantaneous production of the card system can be determined by informing the computer whether each individual card is in operation or not. If the productions of the individual cards have to be separately set, the computer must be informed not only whether a particular card is in operation but also what production has been set at that time for that card.

The circuit shown in FIG. 5A for monitoring the actual operative/inoperative time ratio is not essential. Alternative suggestions have already been disclosed in European Patent Application No. 93235. The optimum time period (T) for monitoring can be empirically determined and then preprogrammed.

The term "installation" in this connection covers a number of processing stages, interconnected by suitable fiber transport means and/or regulating devices in a processing line. The fibers for processing travel through the stages in a preset sequence. The fiber transport means is preferably but not unnecessarily pneumatic. The transport process is in all cases automatic, i.e. without intervention by the operators. Normally, the process is also continuous, i.e. not intermittent.

In accordance with the proceeding proposals, "fine regulation" is carried out by altering the production, which normally results in a change in quality. A method in which the total production of a processing stage or processing machine is variable, but the specific production (production per length unit of the processing width) is kept constant, resulting in constant quality can advantageously be combined with the above-described process.

What is claimed is:

1. A fiber processing installation comprising a plurality of fiber processing stages including at least one stage operable on a discontinuous basis;

conveying means interconnecting said stages for conveying fibers for processing in a preset sequence;

means for generating a signal representative of the total production of a second stage downstream of said one stage; and control means for monitoring the actual ratio of operative time to inoperative time of at least said one stage, said control means being responsive to said signal from said signal generating means to form a set value for the operative to inoperative time ratio of said one stage for comparison with said actual ratio to change the production of said one stage in response to a difference therebetween in order to adjust said actual ratio to said set value.

2. An installation as set forth in claim 1 wherein said downstream stage is a card room.

3. An installation as set forth in claim 1 wherein said one stage is a fiber feed stage for at least one card.

4. An installation as set forth in claim 1 wherein said one stage is a bale material removal unit.

5. An installation as set forth in claim 1 wherein said stages include a plurality of stages operable on a discontinuous basis and said control means monitors the actual operative to inoperative time ratio of each said discontinuously operable stage.

6. A fiber processing installation comprising a plurality of fiber processing stages including at least one stage operable on a discontinuous basis;

conveying means interconnecting said stages for conveying fibers for processing in a preset sequence;

means for generating a set value signal representative of the actual production of a second stage downstream of said one stage;

means for generating an actual value signal representative of the actual operative to inoperative time ratio of said one stage;

a comparator for comparing said actual value signal with said set value signal to emit a difference signal in response to a difference therebetween; and control means responsive to said difference signal to vary the operation of said one stage to adjust said actual value signal to said set value signal.

7. An installation as set forth in claim 6 Wherein said downstream stage is a card room having a plurality of selectively operable cards therein and said means for generating said set value signal is responsive to the total output of said cards.

8. An installation as set forth in claim 7 wherein said one stage is a fiber feed stage for delivering fiber to at least one card.

9. An installation as set forth in claim 6 wherein said one stage is a bale material removal unit.

10. A fiber processing installation comprising a plurality of fiber processing stages disposed in a preset sequence for processing fiber, at least one of said stages being operable on a discontinuous basis;

a master computer connected to at least a continuously operating second stage downstream of said one stage to receive a signal therefrom corresponding to the total production of said second stage for generating a set value signal representative of the total production of said second stage, said computer being connected to said one stage to receive a signal therefrom corresponding to actual operation of said one stage for generating an actual value signal representative of the ratio of operative time to inoperative time of said one stage during a predetermined time interval; and a comparator in said master computer for comparing said actual value signal with said set value signal to emit a control signal in response to a deviation therebetween, said comparator being connected to said one stage to deliver said control signal thereto to alter the actual operation of said one stage.

11. A method of processing fiber comprising the steps of conveying fiber through a plurality of fiber processing stages in a preset sequence with at least one stage operating on a discontinuous basis;

monitoring the actual ratio of operative time to inoperative time of at least said one stage to generate an actual value signal corresponding thereto;

monitoring the total production of a second continuously operating stage downstream of said one stage to generate a set value signal corresponding thereto;

comparing said actual value signal with said set value signal to emit a control signal in response to a deviation therebetween; and delivering said control signal to said one stage to alter the operation of said one stage in response to said control signal.

12. A method as set forth in claim 11 wherein said second stage includes a plurality of selectively operable cards and said set value signal corresponds to the number of said cards in operation.

13. A method as set forth in claim 12 wherein said stage is a fiber feed stage for delivering fiber to said cards.

14. A method as set forth in claim 11 wherein a plurality of said stages upstream of said second stage are operable on a discontinuous basis, and wherein said control signal is delivered to the first of said plurality of stages upstream of said second stage to control the actual production thereof and wherein each downstream stage of said plurality is connected to an upstream stage of said plurality to control the actual production of said upstream stage in dependence on the total production of said downstream stage.

* * * * *

UNITED STATES PATENT AND TRADEMARK OFFICE

CERTIFICATE OF CORRECTION

PATENT NO. : 4,876,769

DATED : October 31, 1989

INVENTOR(S) : WALTER SCHLEPFER, et al

It is certified that error appears in the above-identified patent and that said Letters Patent is hereby corrected as shown below:

Column 1, line 37 "325446719" should be -32544619-
Column 2, line 46 "in stages" should be -in existing plants, feedback circuits being provided between stages-
Column 4, line 50 "is switches" should be -is switched-
Column 4, line 59 "detected the" should be -detected by the-
Column 5, line 10 "a installation" should be -an installation- Column 5, line 43 "master card K." should be -master computer LR monitors the operating state of each individual card K.-
Column 5, line 58 "lines" should be -line-
Column 6, line 46 "device G" should be -comparator G-
Column 6, line 47 "line 10." should be -line 10 (Fig. 4).-
Column 7, line 58 "unnecessarily" should be -necessarily-
Column 7, line 62 "proceeding" should be -preceding-
Column 8, line 49 "Wherein" should be -wherein- Signed and Sealed this Twenty-seventh Day of November, 1990

*Attest:*

HARRY F. MANBECK, JR.

*Attesting Officer*

*Commissioner of Patents and Trademarks*